US005746013A

United States Patent [19]

Fay, Sr.

[11] Patent Number: 5,746,013

[45] Date of Patent: May 5, 1998

[54] SHOE HAVING AN AIR-COOLED BREATHABLE SHOE LINER

[75] Inventor: William L. Fay, Sr., Scituate, Mass.

[73] Assignee: Faytex Corp., Weymouth, Mass.

[21] Appl. No.: 766,024

[22] Filed: Dec. 13, 1996

Related U.S. Application Data

[63] Continuation of Ser. No. 490,009, Jun. 13, 1995, abandoned.

[51] Int. Cl.[6] ..... A43B 1/10; A43B 1/12

[52] U.S. Cl. ..... 36/3 R; 36/3 A; 36/10; 36/55

[58] Field of Search ..... 36/3 R, 3 A, 10, 36/55, 43, 44

[56] References Cited

U.S. PATENT DOCUMENTS

| | | | |
|---|---|---|---|
| 4,073,072 | 2/1978 | Gross . | |
| 4,709,490 | 12/1987 | Föttinger et al. | 36/43 |
| 4,785,558 | 11/1899 | Shiomura | 36/3 A |
| 5,297,296 | 3/1994 | Moretz et al. | 66/177 |
| 5,353,524 | 10/1994 | Brier | 36/10 |
| 5,385,036 | 1/1995 | Spillane et al. | 66/87 |
| 5,461,884 | 10/1995 | Depoe et al. | 36/55 |

*Primary Examiner*—M. D. Patterson

*Attorney, Agent, or Firm*—Watson Cole Stevens Davis, P.L.L.C.

[57] ABSTRACT

A conventional shoe which comprises a shoe upper of continuous and uninterrupted material attached to an outer sole has its shoe upper lined with an air-cooled, breathable shoe liner comprising an outer knit layer of hydrophilic material, an inner knit layer of hydrophobic material, and monofilament yarns of hydrophobic material extending between and interknitted with the outer and inner layers for maintaining an air chamber therebetween, such that moisture from the foot of the wearer is transmitted by the inner layer and the monofilament yarns through the air chamber and is absorbed by the outer layer and passes into the shoe upper to be dried by the outer air.

6 Claims, 1 Drawing Sheet

10
21
12
11
2
16
11
19
17
14
22
15
13
2

14
16
19
18
17

16
19
4
4
17

19
11
14
16
15
22
15
13

SHOE HAVING AN AIR-COOLED BREATHABLE SHOE LINER

This application is a Continuation of application Ser. No. 08/490.009 filed Jun. 13, 1995 abandoned.

BACKGROUND OF THE INVENTION

This invention relates generally to a shoe having a conventional closed shoe upper attached to a conventional outer sole of a dress, casual or sport shoe, or boot. More particularly, an air-cooled breathable shoe liner is provided according to the invention which lines at least the shoe upper for aerating the foot of the wearer to maintain the foot substantially perspiration free.

Multi-layered liners for shoe uppers have been provided as having an intermediate layer of synthetic foam material, such as polyurethane foam, which acts as a cushioning agent. However, the polyurethane foam is not only not breathable but acts as an insulator, containing foot perspiration and heat, which brings about foot discomfort and foot fatigue.

Shoe structures for aerating the foot are known to provide a window opening in the shoe upper covered by a conventional mesh for aerating the foot. However, such shoe structure is costly to produce as a seasonal shoe satisfactory only when worn during warm and dry weather conditions.

A shoe construction restricted to use as a shoe upper for especially an athletic shoe, is disclosed in U.S. Pat. No. 4,785,558 as allegedly exhibiting air permeability and suitable elasticity.

As described, the shoe upper according to this prior patent comprises a three-dimensional structure of outer and inner knit fabric layers, the outer layer preferably being a filament yarn or a spun yarn made of a synthetic fiber having excellent wear resistance, while the inner knit fabric layer is preferably a spun yarn made of a natural fiber having moisture absorbtivity, i.e., hydrophilic. The inner and outer layers are spaced apart and are interknitted by a crossing thread, preferably of a synthetic monofilament or multifilament, using a known Raschel knitting machine.

The shoe upper of such a three-dimensional structure functions unlike that of a shoe liner in that the moisture absorbing inner layer in contact with the foot of the wearer retains moisture due to foot perspiration which interferes with the ability of the shoe upper to air cool the foot. This known shoe upper is mainly structured as a soft, three-dimensional structure for enhancing the effect of alleviating a sense of oppression and a sense of fatigue when used as a shoe upper of an athletic shoe.

SUMMARY OF THE INVENTION

It is therefore an object of the present invention to provide a shoe lining which lines the shoe upper of a closed shoe, which may be of the dress, casual, boot or sport type, for providing an air chamber surrounding the foot which facilitates air circulation keeping the foot dry, avoiding foot fatigue and enhancing foot comfort. The shoe liner is a knit fabric which may be manufactured in a Raschel loom or a warp frame loom of known type. The liner eliminates foam as both a cushioning agent and an insulator, and which instead utilizes an air chamber between the inner and outer spaced knit layers to facilitate air cooling the foot. The air chamber is maintained by monofilament yarns interknitted with the inner and outer layers.

The inner layer of the shoe liner according to the invention comprises a knit layer of hydrophobic material such as a polyester, and the outer layer comprises a knit layer of hydrophilic material such as nylon. The monofilament yarns are of hydrophobic material such as polyester. With such a liner construction, neither the inner layer (against the foot) nor the monofilament yarns, being of hydrophobic fibers, absorbs foot perspiration but pass the moisture vapor and heat through the air chamber to the outer layer of hydrophilic nylon which absorbs all this moisture and passes it through to the shoe upper which evaporates in the atmosphere. Thus, the entire liner is breathable for aerating the foot clad in a standard shoe having a conventional, closed shoe upper. Further, moisture is not absorbed at the inner layer, but is transported away from the foot to the shoe upper for evaporation. The monofilaments are interknitted to both the knitted inner and outer layers for cushioning the foot, which adds softness and comfort for the wearer as well as structured integrity to the composite lining material.

The knitted fabric liner according to the invention may likewise be utilized as an inner sole for lining the outer sole of the shoe which even further adds to the comfort, softness and cushioning features of the shoe.

Other objects, advantages and novel features of the invention will become more apparent from the following detailed description of the invention when taken in conjunction with the accompanying drawings.

DETAILED DESCRIPTION OF THE INVENTION

Figure 1:
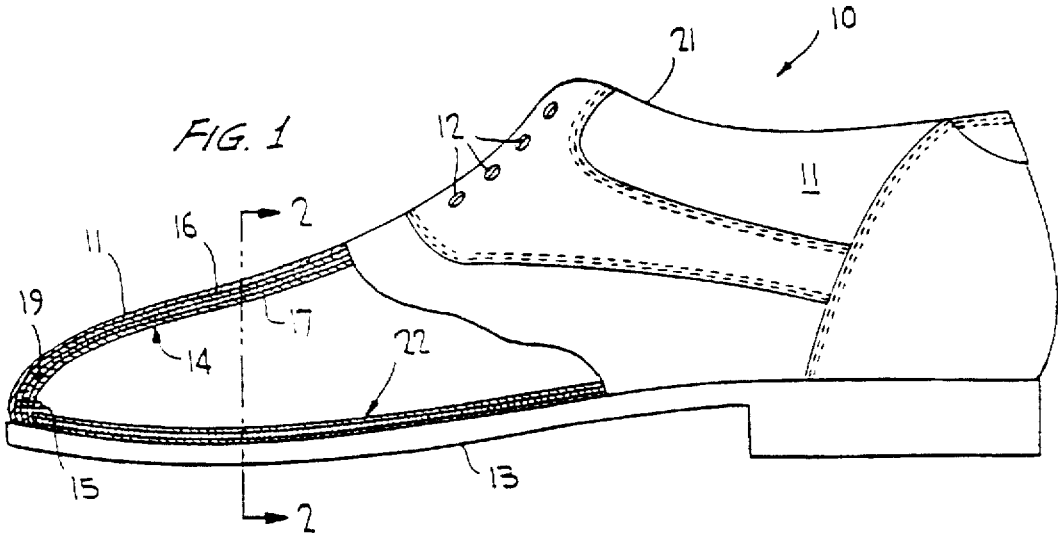
FIG. 1 is a side elevational view of a conventional shoe, partly broken away to illustrate the shoe lining according to the invention.

Turning now to the drawings wherein like reference characters refer to like and corresponding parts throughout the several views, a conventional, completely closed shoe 10 is shown in FIG. 1 incorporating the shoe lining according to the invention, the shoe being illustrated as a dress shoe, although the present shoe lining is likewise adaptable for use with casual and sport shoes and boots, as well.

Shoe upper 11 of the shoe may be of genuine or imitation leather material or the like which completely encloses the foot, i.e., the shoe upper does not have window openings nor is comprised of straps or the like, but is rather continuous and uninterrupted, except, of course, for eyelets 12. The shoe upper is attached to outer sole 13 in any normal manner.

Figure 4:
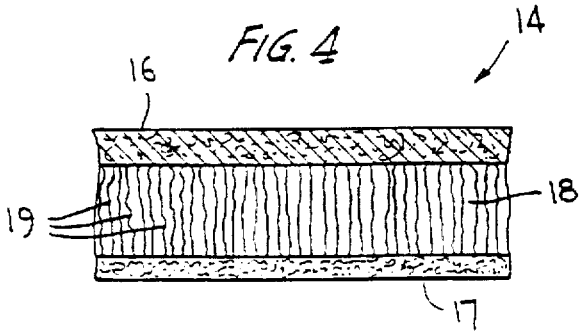
FIG. 4 is a sectional view taken substantially along the line 4—4 of FIG. 3.
Figure 3:
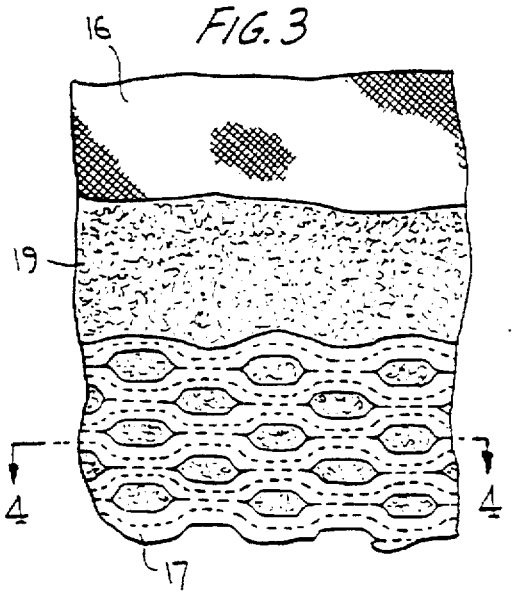
FIG. 3 is a broken plan view at an enlarged scale, of the shoe lining construction according to the invention.
Figure 2:
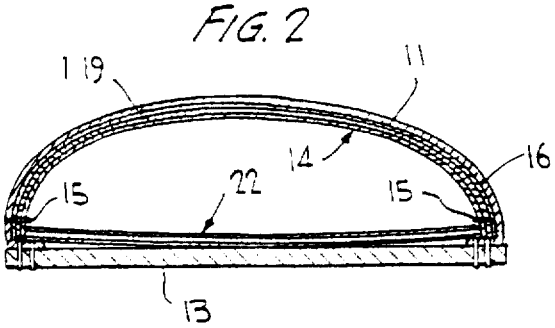
FIG. 2 is a sectional view taken substantially along the line 2—2 of FIG. 1.

Shoe lining 14 according to the invention completely lines the entirety of shoe upper 11 and is attached thereto as by spot stitching 15 (FIGS. 1, 2) or the like. The shoe liner, structured as best shown in FIGS. 3 and 4, includes an outer knit layer 16 in intimate contact with the inner surface of the entirety of shoe upper 11. The outer knit layer is formed of a hydrophilic material such as nylon having a yarn fineness of about 90 denier. The tern "hydrophilic" is to be understood as a property of the material, such as moisture absorbing nylon, having a strong affinity for moisture.

Shoe lining 14 further comprises a inner knit layer 17 which may be textured as shown in FIG. 3 or which may otherwise be plain without departing from the invention. The inner knit layer is of hydrophobic material such as polyester which may have a yarn fineness of about 40–150 denier. The term "hydrophobic" is intended to identify the property of the inner knit layer as lacking affinity for moisture.

The inner knit layer is spaced from the outer layer a predetermined distance to form an air chamber 18 between the layers. The inner and outer layers are maintained in their spaced apart relationship by the provision of monofilament yarns 19 which are interknitted with both the inner and outer knit layers in a known manner such as with the use of the well-known Raschel tricot knitting machine. The monofilament yarns are of a hydrophobic material such as a polyester having a yarn fineness of about 30 denier and extend between the inner and outer knit layers in a substantially perpendicular fashion thereto as exaggerated in FIG. 4.

The inner knit layer, in contact with the wearer's foot, being moisture hating, and the monofilament yarns intermediate the layers, likewise being moisture hating, do not absorb foot perspiration but pass the moisture vapor and heat through the air chamber to the outer layer of moisture loving material which absorbs all this moisture and passes it through to the shoe upper 11 to evaporate in the surrounding atmosphere. The air enters at outer edge 21 of the shoe and circulates through the air chamber about the foot at least inside the shoe upper. The moisture absorbed from the foot by the hydrophobic yarns is transmitted into the shoe upper via outer knit layer 16 to be dried by the outside air. The foot is thus dried and air cooled by the liner which likewise renders the shoe soft, comfortable and cushiony.

Shoe liner 14 according to the invention can likewise be applied as an insole 22 overlying outer sole 13 such that the entirety of the foot is encapsulated by air chamber 18. The movements of monofilaments 18 are entirely flexible and crushable when the shoe liner is utilized as an insole, such that air chamber 18 will be maintained by the tiny monofilaments 19 spanning and interknitted to the inner and outer knit yarns of the insole.

The shoe lining construction of the knitted fabric according to the invention eliminates foam as a cushioning agent, and the layers forming the lining are neither laminated together nor is adhesive required for interconnecting the layers. The shoe upper is lined with the knit fabric according to the invention in any suitable manner known in the shoe construction art, and functions as an air-cooled breathable liner which reduces foot fatigue caused by foot perspiration, and provides a cushiony, comfortable and soft wear.

Obviously, many modifications and variations of the present invention are made possible in the light of the above teachings. For example, elastic or Lycra yarns could be knitted into the liner to produce an integral stretch feature for added foot comfort eliminating the need for shoe laces, buckles, etc. It is therefore to be understood that within the scope of the appended claims the invention may be practiced otherwise than as specifically described.

What is claimed is:

1. A shoe comprising, an outer sole, a shoe upper of continuous and uninterrupted material attached to said outer sole, and an air-cooled breathable shoe liner for lining at least said shoe upper, the liner comprising an outer knit layer of hydrophilic material in engagement with at least an inner surface of said shoe upper, an inner knit layer of hydrophobic material spaced apart a predetermined distance from said outer layer to define an air chamber therewith, said inner layer being adapted to engage a foot of the wearer, and a plurality of monofilament yarns of hydrophobic material extending between and interknitted with said outer and inner layers for maintaining the spaced apart distance of the layers defining the air chamber, whereby moisture from the foot of the wearer is transmitted by the hydrophobic material of the inner layer and the monofilament yarns through the air chamber through which air circulates to dry the foot, absorbed by the outer layer of hydrophilic material, and is transmitted into said upper to be dried by the outer air.

2. The shoe according to claim 1, wherein said outer layer comprises knitted yarns of moisture absorbing nylon.

3. The shoe according to claim 1, wherein said inner layer comprises knitted yarns of polyester.

4. The shoe according to claim 1, wherein said monofilament yarns are polyester.

5. The shoe according to claim 1, wherein said inner layer is textured.

6. The shoe according to claim 1, wherein said liner further comprises an inner sole lining said outer sole.

* * * * *